United States Patent [19]

Hoffenberg et al.

[11] Patent Number: 4,951,937

[45] Date of Patent: Aug. 28, 1990

[54] LOAD MECHANISM FOR EXERCISE DEVICES

[75] Inventors: Mark J. Hoffenberg, Laguna Niguel; Robert A. Walpert, El Toro, both of Calif.

[73] Assignee: Schwinn Bicycle Company, Chicago, Ill.

[21] Appl. No.: 322,560

[22] Filed: Mar. 13, 1989

Related U.S. Application Data

[63] Continuation-in-part of Ser. No. 169,987, Mar. 17, 1988, Pat. No. 4,815,730.

[51] Int. Cl.[5] ..... A63B 21/00

[52] U.S. Cl. ..... 272/73; 272/128

[58] Field of Search ..... 272/73, 71, 72, 128, 272/131, 132, 133; 128/25 R; 188/77 R

[56] References Cited

U.S. PATENT DOCUMENTS 642,919 2/1900 Nott .
763,095 6/1904 Ebken .
1,245,350 11/1917 Hurwitz .
2,382,841 8/1945 Alexander .
4,009,769 3/1977 Nagatomo .

FOREIGN PATENT DOCUMENTS 435851 11/1974 U.S.S.R. .
2175812 12/1986 United Kingdom ..... 272/73

*Primary Examiner*—Stephen R. Crow
*Attorney, Agent, or Firm*—Knobbe, Martens, Olson & Bear

[57] ABSTRACT

In a bicycle-type exercising apparatus, a roller is driven by the rear wheel of the bicycle. The roller is connected to a load device which varies the load resistance experienced by the person exercising on the exercise apparatus. The load device comprises a differential band brake having a pivoted member with the opposite ends connected to opposing ends of a brake band. A spring is inserted between one end of the pivoted member and the corresponding end of the brake band. A self-correcting servomotor is connected to the pivoted member to control the braking force. A computer may be programmed to control the motion of the servomotor, and thus control the forces exerted by the load device.

15 Claims, 2 Drawing Sheets

Fig. 1
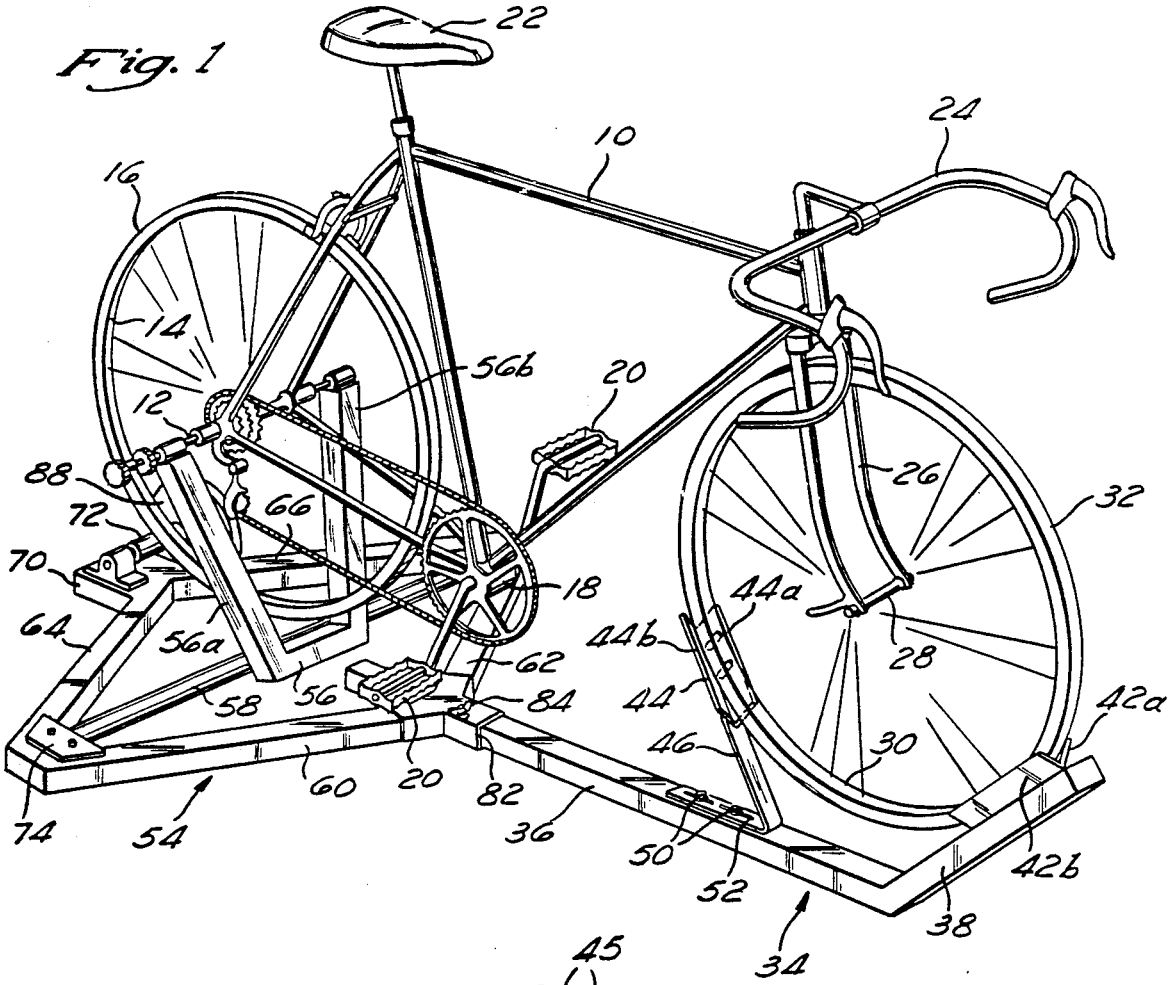
Fig. 4
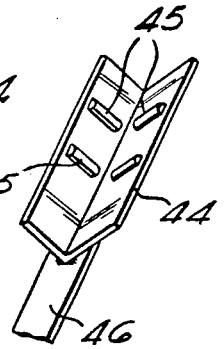
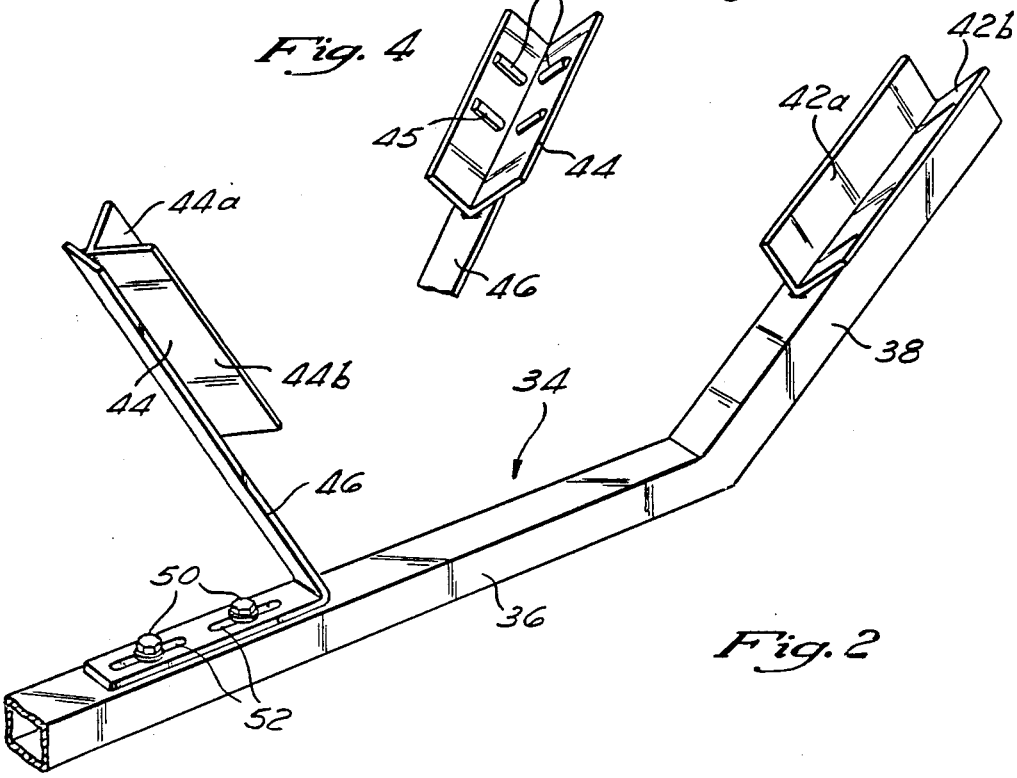
Fig. 2

Fig. 3
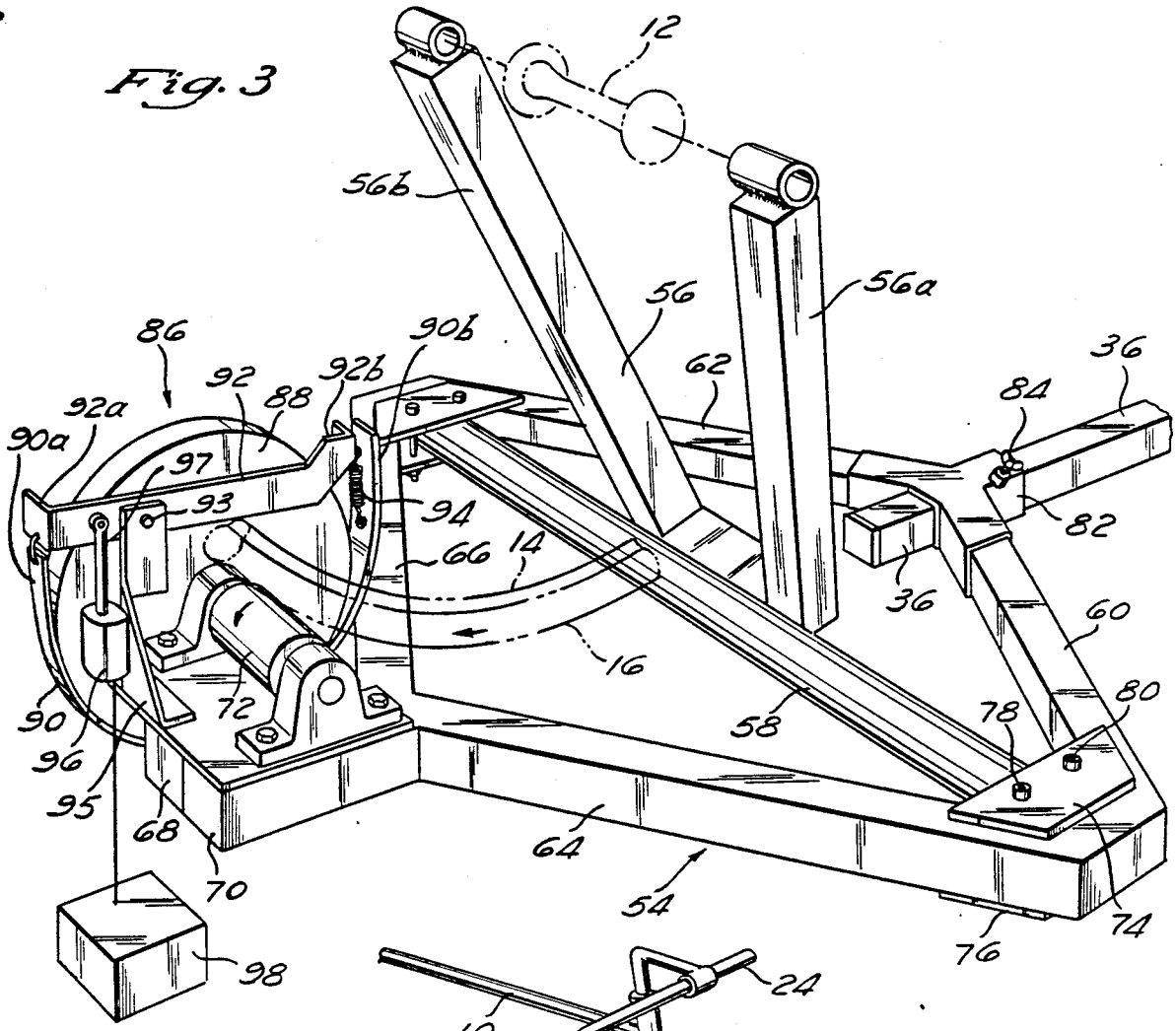
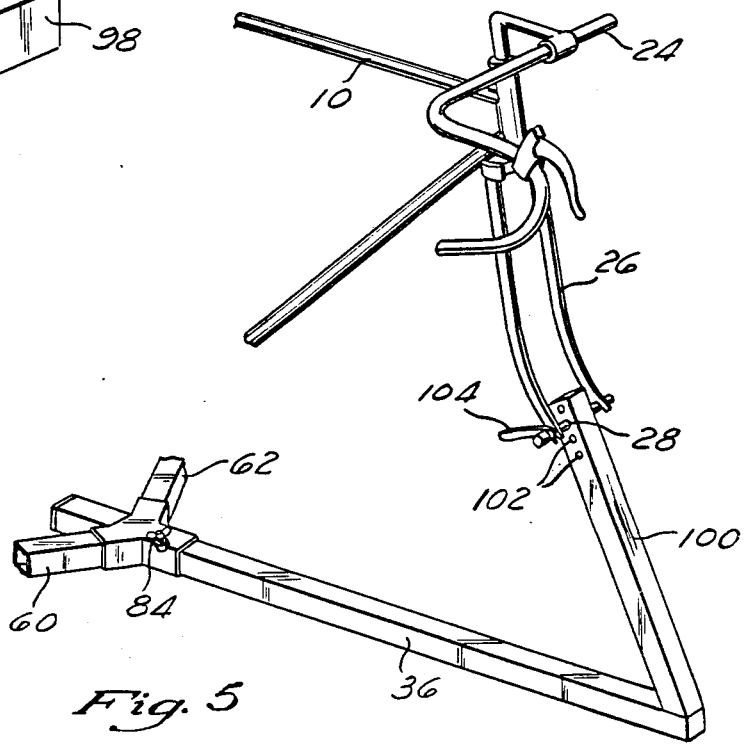
Fig. 5

LOAD MECHANISM FOR EXERCISE DEVICES

RELATED APPLICATIONS

This is a continuation-in-part application of parent patent application, Ser. No. 169,987, filed Mar. 17, 1988, now Pat. No. 4,815,730 inventors Mark J. Hoffenberg and Robert A. Walpert, and entitled "Bicycle Support and Load Mechanism."

BACKGROUND OF THE INVENTION

This invention generally relates to a load mechanism for exercise devices, and more particularly to a load device for bicycle-type stationary exercise and training apparatus. The invention is particularly directed to an apparatus for use with a multi-speed bicycle, and is especially suited to train for bicycle races.

FIELD OF THE INVENTION

A number of present-day gymnasiums and exercise clubs have stationary bicycle-type apparatus, whereby a person pedals a simulated bicycle as a form of exercise. Typically, the bicycle pedals are connected to a frictional device or other load in a way such that the amount of resistance can be adjusted by the person riding the bicycle. Typical examples of this type of stationary bicycle are shown in U.S. Pat. Nos. 4,358,105 (the "Lifecycle") and 4,613,129.

Other exercise devices are adapted so that a conventional bicycle can be mounted to an apparatus which supports the bicycle so that the rear wheel of the bicycle can rotate against a frictional load. These types of devices fall into several general categories, the first of which connects both the front axle and the bottom bracket of the bicycle to a frame in order to support the bicycle. The rear wheel drives against a roller which, in turn, is connected to a loading mechanism. One example of such a device is shown in U.S. Pat. No. 4,441,705 to Brown, in which the rear wheel drives a flywheel and a variable resistance load.

A second type of apparatus used with a conventional bicycle supports the rear wheel, either on a pair of rollers or by a fixed support at the rear axle. For example, U.S. Pat. No. 4,596,386 to Sackl attaches to the rear axle to support the axle at a fixed distance from a pair of rollers. U.S. Pat. No. 3,903,613 to Bisberg supports the front wheel of the bicycle while the rear wheel rests on a pair of rollers.

Each of the above types of devices has numerous drawbacks for use as an exercise device, and as use for a training device for bicycle racing. The stationary, simulated bicycles, like the "Lifecycle," do not provide a realistic pedal resistance simulating that obtained from riding a real bicycle; they do not adequately simulate inertia, wind resistance, terrain variations and rolling resistance. Further, this type of stationary bicycle does not realistically simulate the body position or the feel of riding a bicycle, which is not surprising because a standard bicycle frame is not even used. Further, these types of devices are heavy and bulky.

The devices using a bottom bracket support allow the use of a real bicycle frame, but fail to provide a realistic resistance and ride simulation. This type of equipment usually has one roller contacting the rear wheel.

The devices using a roller or rollers to support the rear wheel have stability and slippage problems. If the roller is behind the rear axle, the roller must be long since the wheel wobbles and moves sideways as it attempts to constantly "fall off" the roller. If the roller is in front of the axle, the wheel stays centered, but does not maintain adequate contact during periods of maximum torque on the rear wheel. In both cases, if a realistic resistance is applied, the rear tire slips on the roller.

For example, during maximum performance periods, the bicycle rider is not on the saddle, but is leaning over the handlebars and essentially standing on the pedals. As the weight of the rider shifts forward, the force on the rear wheel decreases and the weight on the front wheel increases, causing slipping of the rear wheel. Further, in this position with a bicycle on a bottom bracket support, the bicycle pivots about the bottom bracket, effectively removing the rear wheel from contact with the supporting roller or rollers. Thus, just when the maximum resistance is needed to prevent slipping at the rear wheel, the rear wheel is at a minimum friction contact with the resistance rollers and slips.

The rear wheel can be preloaded against the support roller(s), but the preload device duly constrains the rear wheel so as to ruin the realism of the ride, and also destroys the realism of the simulated resistance when the rider is sitting in the saddle or bicycle seat, pedaling at a slower speed. Further, the bottom bracket holds the frame too rigid, destroying the realism of the ride as, in real life, the frame flexes on the wheels.

The devices which use a pair of support rollers on the rear wheel not only tend to be bulky, but require complicated resistance mechanisms on both rollers in an attempt to achieve an appropriate resistance to the rear wheel rotation. Further, they do not simulate the feel of a real ride and may require a different balance and training to be able to remain upright while riding if the front wheel is also supported on a roller, as in the patent to Cassini, et al. (No. 4,580,983). For example, if the front fork is fixed or supported with two rollers on the rear wheel, the rear wheel wobbles and moves while the front is stable. In real life, the rear wheel is stable while the front wheel wobbles or moves. The use of two rollers still does not prevent slipping when the rider comes out of the saddle and leans over the handlebars to exert the maximum force on the pedals. The shift in the rider's weight still causes slippage between the rear wheel and the rollers.

Another type of exercise support apparatus for a bicycle was recently introduced on the market under the name "Velodyne." The Velodyne supports the rear wheel of the bicycle on a roller which is located in front of a vertical plane containing the rotational axis of the rear wheel. The rear axle is allowed to rotate with the rear wheel, but is constrained to move along an arcuate path by two members which pivot about a common axis located behind the vertical plane. When a rider leaves the saddle of the bicycle and leans over the front handlebars, the members constrain the rear axle to move in an arcuate path. A forward shift in the riders weight moves the bicycle forward and the pivot members force the rear wheel into contact with the support roller so that frictional contact is maintained between the roller and the rear tire. The Velodyne unit uses an electrically-powered alternator and a flywheel to apply a variable load to the roller and thus to the rear wheel of the bicycle. A computer is used to vary the load applied by the alternator. The Velodyne type of unit is described in more detail in patent application No. 054,749, filed May 26, 1987 in the United States Patent Office.

There is still a need for a device which provides a realistic ride on a bicycle and a realistic resistance, especially so that slippage does not occur when the full weight of the rider is on the pedals to obtain maximum power. Further, there is a need to make such a device of simple construction portable, especially one which can be used with an individual's own bicycle to provide the maximum realism for training purposes.

Another aspect of this invention is the realistic simulation of the ride and load resistance experienced when riding a bicycle. The load variables can include wind resistance, whether the rider is going uphill or downhill, the inertia of the rider and bicycle, the friction inherent in the bicycle itself, and the frictional resistance between the bicycle tires and the riding surface.

Previous attempts to accurately replicate these various load effects have all had their drawbacks. For example, the effect of wind resistance has been simulated by rotating fan blades which are mechanically coupled to the rotational speed of the bicycle wheel. While the rotating fan blades can provide a force that increases as the square of the rotational speed of the fan blades, these fans are noisy, inaccurate, not readily adjustable, and cannot be adjusted to account for a variation in wind resistance that will occur with riders of different size and weight.

Similarly, prior devices have attempted to simulate the amount of load to be applied by either a mechanical or electronic brake system. A typical mechanical brake involves a friction belt that wraps around a moving surface to cause a frictional drag on that rotating surface depending upon the tension in the belt. These mechanical systems, however, cannot be accurately calibrated, have a slow response time, and are subject to load variations over time as the elements of the mechanical system go out of adjustment and alignment. Further, the frictional load varies with the environmental temperature, and with the temperature of the frictionally engaging parts. The mechanical systems thus have poor repeatability, high variations in drag, and are difficult or impossible to accurately calibrate to a given load. Further, a large force is typically required to be exerted on the friction bands in order to adequately vary the frictional loads.

The electronic braking systems have advantages over the mechanical systems, but the accuracy of the simulated ride depends upon several factors, including how accurately the system can be calibrated, and the realism of the program with which the electronic brake is varied. An example of variations in the simulation accuracy would be the wind resistance. A fan blade may simulate a load that varies with the speed of the bicycle wheel, but it cannot simulate the load resistance that varies with the size and the weight of the rider, or the wind load variation that occurs from riding at the front of a pack, or in the middle of a pack of other bicycle riders.

Thus, there is a need for a more realistic simulation of load variability, and especially the wind load variability. The ability to simulate a realistic load by a lightweight, low force system is especially needed.

SUMMARY OF THE INVENTION

Briefly described, the apparatus comprises a frame to which a bicycle is mounted. A front wheel of the bicycle rests against a ramp such that when a rider puts weight on the bicycle, the bicycle tries to roll backwards. The rear axle is held by a pivoting support, which swings a rear tire of the bicycle against a roller located behind the bicycle, as the bicycle moves backwards. Resistance is applied to the roller to simulate riding on a road.

In more detail, the subject apparatus supports a bicycle, the bicycle comprising a frame to which are connected a seat, handlebars, a front fork with a front wheel and tire rotatably mounted on a front axle, and a rear wheel and tire rotatably mounted on a rear axle. The apparatus has rolling means, comprising at least one roller, which contacts the rear tire when the bicycle is mounted on the apparatus. The roller supports a portion of the weight on the bicycle and transmits a variable load to the rear tire to simulate the loads experienced during riding.

Additional support means are provided by a rearwardly inclined pivoting support member which pivots about a pivot axis and is constructed to urge the rear tire into contact with the roller as the weight of the rider shifts forward from the seat toward the handlebars. The pivot support member rotatably supports the rear axle to allow the rear wheel to rotate about the rear axle, but constrains the axle to move along a predetermined path about a pivot axis. The pivot axis is located forward of the roller, and on the opposite side of a vertical plane containing the rear axle, where the forward direction is from the seat toward the handlebars.

A forwardly inclined ramp abuts the front tire so the front tire rolls down the ramp and moves rearward when a rider moves off the bicycle seat toward the front tire. A rearward direction is from the handlebars toward the seat. A rearwardly inclined ramp abuts the front tire on the opposite side of the wheel as the front ramp. A support is connected to the rearwardly inclined ramp, with the support having a stiffness which permits the front wheel to move downward and rearward at a predetermined rate. Restraining means are provided on the front and rear ramps, with the restraining means contacting opposing sides of the front tire to stabilize the front of the bicycle by inhibiting turning of the front wheel and tire as the handlebars are turned.

A variable load means is provided by a differential band brake drum which is connected to the roller to vary the load transmitted from the roller to the rear tire. The band brake can also provide inertial loads. A servomotor is connected to the band brake to maintain the torque exerted by the band brake on the roller at a predetermined value, although a mechanical linkage could also be used in place of the servomotor. A computer communicates with the servomotor to vary the torque exerted by the band brake on the roller to follow a predetermined load profile generated by, or stored in, the computer.

In an alternate embodiment, the front fork is connected to a rearwardly extending support member that replaces the forwardly inclined ramp. The rearwardly extending support can attach to the inside of the front fork, in which case the front wheel and tire are removed or it can straddle the front wheel and tire to connect to the outside of the front fork. The rearwardly extending support has a stiffness, and is at such an inclination, that it exerts a rearward force on the front fork as the weight of the rider shifts forward from the seat toward the handlebars.

In a further embodiment, the front tire of the bicycle rests on the ground and need not be supported. The pivoting support members connecting to the rear bicycle axle are rearwardly inclined, with the pivot axis of the pivoting support members and the rotational axis of the roller being located rearward of, and on the same side of, a substantially vertical plane through the rear axle of the bicycle.

BRIEF DESCRIPTION OF THE DRAWINGS

A specific embodiment of an exercise device in accordance with the invention is described hereinafter, with the aid of the accompanying drawings in which like numbers refer to like parts throughout.

FIG. 1 is a perspective view of a bicycle on the apparatus of this invention;

FIG. 2 is a perspective view of a portion of a pivot frame of this invention showing restraining means for use with a front tire of a bicycle;

FIG. 3 is a perspective view of a portion of the apparatus of this invention showing a differential band brake and a yoke;

FIG. 4 is a detailed perspective view of a restraint shown in the above Figures; and FIG. 5 is a perspective view of an alternate embodiment of a support for the front wheel of the bicycle.

DETAILED DESCRIPTION OF THE PREFERRED EMBODIMENTS

Referring to FIG. 1, there is shown a conventional multi-speed bicycle having a frame 10 which is rotatably connected to a rear axle 12. A rear wheel 14 is mounted with a rear tire 16, both of which are centered to rotate about rear axle 12. The frame 10 also contains a bottom bracket 18 to which pedals 20 are rotatably mounted. Above the bottom bracket 18 is located a seat 22 on which a rider can sit. Forward of the seat 22 are the handlebars 24 which are connected to the front fork 26 so the handlebars 24 and fork 26 are connected to, but can rotate, or "turn," with respect to the frame 10. At the end of the fork 26 is rotatably mounted the front axle 28. The front wheel 30 is mounted with a front tire 32, with the wheel 30 and tire 32 being connected to rotate about the front axle 28. The front wheel 30 and front tire 32 will be referred to as "rotating" about front axle 28, while rotation of the handlebars 24 will cause the front wheel 30 and front tire 32 to "turn" with respect to the frame 10.

A bicycle support and load mechanism 34 constructed in accordance with this invention, supports the bicycle frame 10 and attached components. The support mechanism 34 comprises a ground engaging connecting member 36 which advantageously takes the form of a tubular metal member having a round cross section of about 1.25 inches, with a wall thickness of about 0.06 inches. The drawings show square tubular sections which are also suitable, although the round cross section is easier to bend. The connecting member 36 is oriented along the length of the bicycle frame 10 and is located generally below the wheels 14 and 30.

A first end of the connecting member 36 extends below the front tire 32. The downward force direction is from the seat 22 toward the bottom bracket 18. At a point generally below the front axle 28, the connecting member 36 is inclined upward to form front wheel support member 38. Stated in another way, the front wheel support member 38 forms a forwardly inclined ramp generally forward of the pivot axis 28 of the front tire 32.

A front restraint 42 is connected to the front wheel support 38 and is also in an upward inclination. The front restraint 42 is advantageously formed from a single member, such as a piece of round tubing crushed into a member with a crescent shaped cross-section, or from a piece of angle iron having sides 42*a*, 42*b* at right angles and joined at an apex which is connected to and oriented along the length of the front wheel support 38. The front restraint 42 is positioned such that the front tire 32 contacts both sides of the restraint 42*a*, 42*b*.

A similar piece of angle iron is used to form a rearwardly inclined member, or rear restraint 44, having sides 44*a*, 44*b*. A positionable bracket 46 supports and connects the rear restraint 44 to the connecting member 36. The bracket 46 is adapted to be positioned along the length of the connecting member 36 by positionable fastening means which are illustrated as comprising a pair of bolts 50 having a threaded end (not shown) which extends through slots 52 in the bracket 46 so that movement of the bolts 50 within the length of the slots 52 allows adjustable positioning of the bracket 46.

FIG. 4 shows an advantageous embodiment of the front restraint 44, in which the sides 44*a*, 44*b* of the angle iron form a support for a plurality of rollers 45 oriented so the rollers 45 roll with rotation of front tire 32. The rollers 45 provide a means for minimizing the resistance to rotation of the tire 32.

The inclined restraints 42 and 44 are positioned to abut opposite sides of the front tire 32 when a rider is in the saddle 22, and also preferably positioned so that the front tire 32 does not actually contact the connecting member 36.

Located generally below the rear wheel 14, and in the same (horizontal) plane as member 36, is a pivot support frame 54. Frame 54 supports a pivotally mounted yoke 56, having first and second members 56*a*, 56*b*, respectively, which straddle the rear wheel 16. A first end of the members 56*a* and 56*b*, is removably connected to opposing ends of rear axle 12 to allow the rear wheel 14 to rotate about the rear axle 12, while constraining the rear axle 12 to move about a pivot axis. Suitable removable connections for this purpose are known in the art and are not described in detail herein.

The opposite ends of members 56*a*, 56*b* are connected to a pivoting support tube 58. The support tube 58 has a longitudinal axis substantially parallel to the rotational axis of rear axle 12, and is mounted in pivot frame 54 to rotate about that axis. Preferably, the members 56*a*, 56*b* are connected so they pivot together. These members 56*a*, 56*b* are rearwardly inclined, as described later. The rear axle 12 is thus constrained to pivot about the longitudinal axis of pivot support tube 58.

The pivot frame 54 is advantageously made of tubular material having a round cross section, and is symmetrical in construction. Again, the drawing shows a square cross-section, but round is believed to offer some additional advantages in forming over the square tubing. Frame 54 includes members 60 and 62, each having a first end located adjacent opposite ends of pivot support tube 58, and a second end terminating at, and connected to, connecting member 36. Frame 54 further includes members 64 and 66 each having one end located adjacent the axis which runs along the length of connecting member 36, with the opposite ends of members 64 and 66 respectively connected to the ends of members 60 and 62, adjacent the ends of pivot support tube 58.

The abutting ends of members 64 and 66 extend for a short distance away from connecting member 36, along the longitudinal axis running the length of member 36, to form tail members 68 and 70 (FIG. 3). Metal roller 72 is mounted on the top of tail members 68, 70 such that roller 72 has its axis of rotation located in a plane substantially parallel to a substantially vertical plane containing the rear axle 12. The roller 72 preferably has its axis of rotation substantially parallel to the rotational axis of bicycle rear axle 12 and to the pivot axis of pivot support tube 58. A roller 72 having a 1.5 inch diameter is believed to be suitable.

Referring to FIG. 3, the pivot support tube 58 is pivotally connected to the pivot frame 54 as follows. Upper and lower plates 74, 76, respectively, are placed on the upper and lower sides of the juncture of members 60, 64. Two bolts 78, 80 extend through the plates 74, 76, with the bolts being spaced apart a distance sufficient to accommodate the diameter of pivot support tube 58. One end of the pivot support tube 58 extends between the plates 74, 76 and between the bolts 78, 80, so that the pivot support tube 58 can rotate about its longitudinal axis but is restrained from lateral movement. The members 60, 64 prevent the pivot support tube 58 from translating any substantial distance along its longitudinal axis. The juncture of tubes 62, 66 is similarly constructed to allow rotation of the pivot support tube 58, but to restrain axial and lateral translatory movement of the support tube 58. A detailed illustration and description of that structure will not be repeated.

The pivot frame 54 is adapted to be positioned along the length of connecting member 36. Referring to FIG. 3, members 60, 62 join one another adjacent member 36, and form an aperture 82 corresponding to the shape of, but slightly larger in size than, the connecting member 36. Thus, connecting member 36 extends through aperture 82 at the juncture of members 60, 62. A threaded retainer such as thumb screw 84 extends through the structure of one of members 60 or 62 into the aperture 82 so that it can frictionally contact member 36 to lock frame 54 in a selected position along member 36.

The function of the bicycle support and load mechanism 34 is as follows. The front tire 32 is placed in the front and rear restraints 42, 44 so that the front wheel 30 and fork 26 are restrained from turning as the handlebars 24 are turned. The front restraints 42, 44 thus help maintain the stability of the front of the bicycle.

Depending upon the size of the wheel 30, the positionable bracket 46 can be adjusted to position the rear restraint 44 and thus accommodate different sizes of bicycle wheels 30. The bracket 46 can also be used to adjust the spacing between the restraints 42, 44, which has the effect of varying the distance between the front tire 32 and the connecting member 36, so that as the distance between the restraining members 42, 44 is decreased, the front bicycle tire 32 is caused to be increasingly elevated above the connecting member 36.

The rear bicycle wheel 14 is partially supported by the roller 72 which contacts the rear bicycle tire 16, and also by the members 56*a*, 56*b* which form a yoke that straddles the rear bicycle tire 16 and connects to the rear bicycle axle 12. The thumb screw 84 (FIG. 3) is used to adjust the position of the pivot support frame 54 on connecting member 36 to accommodate different sizes of bicycle frames 10, i.e., frame 54 is translated along member 36 to accommodate bicycles having different wheel bases and different wheel sizes.

When properly adjusted, the rotational axis of the pivot support tube 58, and the rotational axis of the roller 72, are on opposite sides of the substantially vertical plane containing the rear axle 12, with the rotational axis of the pivot support tube 58 being located in front of the vertical plane containing the rear axle 12, where the term "front" is defined when viewing the bicycle from the seat 22 toward either the front wheel 30 or the handlebars 24. The members of yoke 56 thus extend rearwardly toward the rear axle 12.

When a rider sits in the seat 22 and pedals the bicycle, the weight of the rider forces the tire 16 into frictional engagement with the roller 72. A portion of the rider's weight is absorbed by the yoke 56 so that the frictional engagement with the roller 72 can be varied by altering the orientation of yoke 56.

Preferably, the yoke 56 is at an angle of about 30°, with respect to a vertical plane containing the rotational axis of pivot support tube 58, or 60° with respect to the horizontal plane containing member 36 and frame 54. Rearward inclination angles of up to 45 degrees with respect to the vertical, are believed to also work, but less satisfactorily.

It is believed possible to eliminate the use of a front fork support such as member 100 (FIG. 5) or inclined member 38, by using a rearward inclination angle of 45 degrees with respect to the vertical. In such a situation, the front tire 32 would rest on the ground. While believed possible, this arrangement is not preferable as the load simulation is not optimum, and since frictional contact between the roller 72 and rear bicycle tire 16 is compromised, especially when a rider leaves the seat 22 and exerts full force on the pedals 20.

It is believed possible, though not preferable, to incline the members 56*a*, 56*b* forward as much as 15 degrees with respect to the vertical, in which event a severe angle on the ramp of the forwardly inclined support member 38 is required (on the order of 70 degrees from the horizontal). In this forwardly inclined mode, the pivot axis of pivot support tube 58, and the rotational axis of roller 72, are on the same side of a substantially vertical plane passing through the rear bicycle axle 12.

For a 27 inch diameter wheel 16 and tire 18, the axis of roller 72 is behind, or rearward of the rear tire 16, and about four inches above the bottom of the tire 16, but contacting the tire 16. The pivot axis of support tube 58 is about level with the bottom of the tire 16, which is at about ground level, but located forward of the tire 16. The pivot axis of support tube 58 is about 14.8 inches forward of the rotational axis of roller 72. Again, the "forward" direction is from the seat 22 toward the handlebars 24.

As a rider rises up off the seat 22 and shifts the rider's weight forward toward the front wheel 30, the frictional contact with roller 72 is maintained. The shift of the rider's weight toward the front wheel 30 causes the front tire 32 to roll down the incline of front wheel support 38, which has the effect of forcing the bicycle, and especially the rear tire 16, toward the roller 72.

The amount which the front tire 32 moves rearward depends upon the inclination of the front wheel support 38, and also upon the bending stiffness of support bracket 46 and restraint 44. The stiffness depends on the material used, as well as its thickness and configuration. For a fixed ramp angle or inclination angle, the lower the stiffness of bracket 46 and restraint 44, the greater the downward movement for a given amount of weight, and thus the greater the rearward movement of the bicycle toward the roller 72. With this rearward movement of the bicycle, the yoke 56 swings the rear tire 16 downward into contact with the roller 72. A $\frac{1}{4} \times 1$ inch piece of strap steel at 45 degree angle from the horizontal is believed suitable.

The front wheel 30 and tire 32 move rearward as the tire 32 rolls down the inclined wheel support 38. Preferably the rear restraint 44 and bracket 46 do not inhibit this rolling action or this rearward movement. The rollers 45 facilitate rolling of the tire 32, since otherwise the tire 32 may be slightly held by frictional contact to the restraint 44.

To further facilitate this rearward movement, the stiffness of the restraint 44 and bracket 46 should be low in the rearward direction, yet provide sufficient upward support to the front tire 32 to position it vertically with respect to the connecting member 36. The stiffness of the restraint 44 and bracket 46 can be selected to vary or control the rate at which the front wheel 30 moves downward and rearward. As the stiffness of the restraint 44 and bracket 46 increase, however, the inclination of the ramp, or inclined support member 38, must increase in order to exert additional force to overcome the resistance to rearward movement caused by the increased stiffness.

The stiffness of the restraint 44 and bracket 46 is less than the stiffness of the inclined support member 38, at least in the rearward direction. Preferably, the location, inclination and stiffness of the restraint 44, bracket 46, and support member 38 are such that the front tire 32 is about one inch from the restraint 44 when no rider is sitting in the saddle 22, with the tire 32 just contacting the restraint 44 and support 38 when the rider sits in the saddle. Preferably, the tire 32 does not contact the connecting member 36 as that could inhibit rearward movement of the bicycle.

Note that the stiffness of the front wheel support 38 and front restraint 42 should be greater than the combined stiffness of the frame 10, fork 26, wheels 14, 30 and tires 16, 32 in order to cause a force to be exerted onto the roller 72 as the rider's weight shifts over the front wheel 30. If the stiffness on the front wheel support 38 and front restraint 42 is too low, the amount of force exerted through the above components and frame 10, toward the roller 72, is lessened.

There is thus provided a force means connected to the bicycle for exerting a rearward force on the rear tire 16 when the weight of the rider shifts off the bicycle seat 12 toward the handlebars 24. In short, a forward shift in the riders weight causes a rearward movement of the bicycle.

As the riders weight shifts forward, the rearwardly inclined members of yoke 56 inhibits forward movement of the rear bicycle wheel 14 and tire 16, forcing the rear axle 12 to move along a predefined arcuate path about the rotational axis of support tube 58. Depending on the stiffness and orientation of yoke 56, the resulting frictional contact between the roller 72 and rear tire 16 can also be varied. As the angle of the yoke 56 with respect to the horizontal decreases, more force is applied to roller 72 by the rear tire 16. A yoke angle of 35–40 degrees with respect to the vertical, and 45–50 degrees with respect to the horizontal, are believed sufficient to prevent slippage between the roller 72 and tire 16 even without an inclined support member 38. The yoke angle must be 45 degrees or greater with respect to the vertical in the above situation to support the rider out of the saddle, and then the friction between the roller and tire is extremely high, ruining the simulation of real riding conditions.

Thus, the yoke 56 also helps control the amount of frictional contact between the tire 16 and the roller 72 as the rider's weight shifts from the seat 22 toward the front wheel 30. The yoke 56 provides pivoting support means which urge the tire 16 into contact with the roller 72 as the rider shifts his or her weight forward, effectively swinging the rear tire 16 into contact with the roller 72 to prevent slippage.

The effective stiffness of yoke 56, of the restraints 42, 44, and of the front wheel support 38 and bracket 46, also affect the realism of the ride simulation. This is especially true of the restraints 42, 44, the support 38 and bracket 46, since a nonlinear stiffness can result in one stiffness occurring when the front wheel is supported between the bracket 46 and support 38, and a second (higher) stiffness occurring when the front tire 32 contacts the connecting member 36.

The appropriate combination of stiffness provided by the orientation and construction of the yoke 56, roller 72, restraint 44, bracket 46, and support member 38 are intended to provide minimal friction between the rear tire 16 and roller 72 during normal riding of the bicycle. Just enough friction is applied to prevent slipping. During periods of high work output, as when the rider is out of the saddle, the tire/roller friction increases to prevent slippage.

Referring to FIG. 5, an alternate embodiment of a means for supporting the front fork 26 is shown. The front wheel support 38 (FIG. 1) is removed and replaced by a rearwardly extending front support member 100. A first end of support member 100 is connected to connecting member 36, with the opposite end being removably connected to front fork 26. The support member 100 preferably has a tubular construction similar to that of connecting member 36, but sized for a predetermined stiffness, and sized to permit the fork 26 to move rearward and downward at a predetermined rate.

One such means of removable connection between the support member 100 and the front fork 26 is to locate a plurality of holes or apertures 102 in the appropriate end of front support member 100, so that the front bicycle axle 28 can be passed through the member 100 and removably fastened by a quick release skewer 104.

In the illustrated embodiment, the front wheel 30 and front tire 32 must be removed. If the front support member 100 took the form of a yoke connecting to the front fork 26 at the ends of the front axle 28, and straddling the front wheel 30 and front tire 32, then the front wheel 30 and front tire 32 could remain attached to the front fork 26.

As the weight of the rider shifts forward from the seat 22 toward the handlebars 24, the front support member 100 bends downward and rearward, causing the bicycle to move rearward, and forcing the rear tire 16 (FIG. 1) into contact with the roller 72 (FIG. 1). This rearward motion and force again prevents slipping between the roller 72 and rear bicycle tire 16.

Referring to FIG. 3, there is shown a differential band brake 86 which is used to apply a variable load to the exercise device via the roller 72, and thus to the rear tire 16. The band brake 86 comprises a disc-shaped drum, which is used as both a brake, and a flywheel and will be referred to, as flywheel 88 having a diameter of about 8 inches and a thickness of about 1 inch, made of steel and weighing about 14 pounds. The rotational axis of the flywheel 88 coincides with the rotational axis of roller 72. The roller 72 is connected to the flywheel 88 so that they rotate simultaneously, with the flywheel 88 simulating inertial loads which are applied to and transmitted by the roller 72.

A flexible brake band 90 abuts against the outer diameter of the flywheel 88 for an arc of approximately 180°. A first end 90a of the brake band 90 is connected to a first end 92a of a link pivot 92, with the opposite end 90b of the brake band being connected to the opposite, second end 92b of link pivot 92 through a spring 94. The spring 94 has a stiffness of about 1.7 pounds per inch.

The link pivot 92 is pivotally mounted at pivot point 93 to a support structure 95 mounted on the tail members 68, 70 (FIG. 1). The distance from pivot point 93 to the first end 90a of the brake band is about 2.5 inches, with the distance from the pivot point to the end 90b of the brake band being about 5.6 inches. Thus, the distance from the pivot point 93 to the connection of the end of brake band 90b with end 92b is about 5.6/2.5=2.2 times the distance from the pivot point 93 to the connection of the end of brake band 90a with end 92a. While the 2.2 ratio is illustrated, the ratio could be greater, or smaller, with ratio's between about 1.7 and 3.0 also believed suitable for use. The pivot point of the link pivot 92 is approximately 2.75 inches above the rotational axis of the flywheel 88, and about 1.5 inches rearward, or away from the center of the flywheel 88.

Band brake control means are mounted off of the tail members 68, 70. The band brake control means could comprise a mechanical linkage, but more advantageously includes a servomotor 96. A moveable connecting member 97 on the servomotor 96 is connected to the link pivot 92 intermediate the connection with the end of the brake band 90a and the pivot point 93. The connection of the member 97 of servomotor 96 is approximately 0.8 inch horizontally away from the pivot point of the link pivot 92.

The pivot point 93 is selected intermediate the ends 92a and 92b of link pivot 92, so that the forces exerted on the ends 92a and 92b are about equal. An assumed coefficient of friction of 0.25 results in the 2.2 ratio of the distances from the pivot point 93 to the ends 92a and 92b of link pivot 92 to accomplish this load equalization. Balancing the loads exerted on the ends of link pivot 92 is against conventional teachings for brakes in which an adjustable force is desired, since the balanced load condition creates a band brake 86 which will be self locking with the slightest motion of the link pivot 92.

To prevent self locking, a member is inserted between the band brake 90 and the link pivot 92 to allow relative motion between the two elements and limit the self locking of the brake. Advantageously, a resilient member, such as the spring 94 is inserted between the brake band 90 and the link pivot 92 to accommodate variable motion between the 92b of link pivot 92 and end 90b of band brake 90.

If the stiffness of the spring 94 is extremely high, then a slight tilting of the link pivot 92 will cause self locking of the band brake 86. If the spring 94 has an extremely low stiffness, then a large amount of motion will be allowed by the link pivot member 92 without self locking. If the stiffness of the spring 94 is between these two extremes, rotation of the link pivot member 92 will cause a braking force to be exerted by the brake band 90 with the braking force depending on the amount of extension or deflection of the spring 94.

The stiffness of the spring 94 may advantageously be selected by determining the allowable amount of movement the end 92b of link pivot 92, and the desired force or torque to be exerted. In the illustrated embodiment, the servomotor 96 has a limited motion which, since it is connected to the link pivot 92, limits the travel of the ends of link pivot 92. The maximum desired torque was selected as about 19 inch-pounds, which corresponds to about ⅛ horsepower at five miles per hour. Having selected the maximum desired force to be exerted, and knowing the allowable movement of the ends of the link pivot member 92, the spring stiffness may be determined from the equation:

$$Force = Spring\ Stiffness \times Deflection$$

A significant feature of the present invention is that the servomotor 96 is, relatively, a very small motor. Since the force on the ends of the link pivot 92 are about equal, a relatively small force may be used to move the link pivot 92 and vary the braking force exerted by the bank brake 86. Thus, a 50 inch-ounce servomotor, which is typically used in radio-controlled airplanes, has been found suitable.

The servomotor 96 is designed to be self-correcting such that if it is directed to a predetermined position, the servomotor 96 will readjust the position as needed to maintain that predetermined location. Since the position of the link pivot 92 is determined by the servomotor 96, the position of the link pivot 92 is also self-correcting. Thus any movement of the link pivot 92 from external sources will cause the servomotor 96 to loose its position, and the servomotor will correct for this movement and maintain the predetermined position of the link pivot 92. Thus, the servomotor 96 compensates for load variations in the band brake.

Movement of the servomotor 96 is advantageously controlled by a programmable computer 98. In a manner well known in the art, the computer 98 is programmed to provide a sequence of movements to the servomotor 96 so that a predetermined torque or load pattern can be exerted on the brake of flywheel 88 and thus exerted on the rear bicycle tire 16. As a result, the combination of the programable computer 98, servomotor 96 and the differential band brake 86 can be used to simulate a variety of riding conditions via computer control of the servomotor 96, while the inertial of the flywheel 88 helps to simulate inertial loads.

The use of a computer-controlled servomotor in conjunction with the differential band brake is believed to provide new and surprising results not heretofore achievable with exercise devices. The flywheel 88 is substantially smaller than flywheels used with band brakes or caliper brakes on prior art devices, and not only provides inertial loads, but doubles as a brake mechanism for load application purposes. The self correction aspect of the servomotor 96 simplifies construction and design. The amount of force required to actuate the braking mechanism is surprisingly small and requires a much smaller source, and much less power consumption than prior art devices. The simplicity of construction, the weight savings and the power savings provide a very portable system which is yet capable of realistic load simulations to an extent not previously available for use with bicycle exercise devices. The ability to program the computer 98 to vary the load exerted by the differential band brake 86 through the small servomotor 96 provides for a very realistic load simulation by a significantly smaller and lighter weight device than previously possible for such load simulators. The ability to program the computer 98 also allows compensation of predictable errors and variances which occur in the differential band brake 86. Thus, the accuracy is unexpectedly high for such a small and lightweight system.

While the band brake loading device is described in connection with its use on a bicycle-type of exercise device, the use of the loading device is not so limited, as the loading device is believed suitable for use on other exercise devices. The shaft on which the flywheel 88 is mounted can be connected to other exercise devices instead of the roller 72, with the connection being made either directly by use of a common drive shaft, through a chain and sprocket connection, or through a geared connection.

We claim:

1. An apparatus for applying loads to a bicycle exercise device where a resistance load is applied to the pedals of the exercise device to simulate the loads experienced during riding a bicycle, comprising a resistance roller; means for mounting a bicycle to said apparatus so that the pedals of the bicycle resistively communicate with the roller;

a differential band brake to exert a resistance force; the differential band brake comprising:

a rotatably mounted drum having a friction surface at its outer periphery, the drum being selected to be of sufficient size to simulate the inertial loads of a bicycle and rider;

a link pivot member having a first and second end, the link being pivotally mounted intermediate the first and second ends;

a spring member connected to one end of the link member; and a brake band adjacent a portion of the friction surface of the drum, the brake band having a first end connected to the first end of the link pivot member, and a second end connected to the spring member;

positioning means connected to the link pivot member intermediate the first and second ends of the link pivot member to position the link pivot member so as to cause the brake band to frictionally engage the drum to cause a resistance force to be exerted; and means for communicating the resistance force from the brake to the roller.

2. An apparatus as defined in claim 1, wherein said positioning means comprises a self-correcting servomotor.

3. An apparatus for applying variable loads to a bicycle wherein a resistance load is applied to a roller which resistively communicates with the pedals of the bicycle device, comprising:

a differential band brake communicating with the roller to exert a variable resistance load on said roller, the differential band brake further comprising:

a rotatably mounted member having a friction braking surface on its periphery, the rotating member connected so as to transmit resistance forces to said roller;

a pivotally mounted member having a first and second end, the member being pivotally mounted intermediate the first and second ends;

a brake band adjacent at least a portion of said friction braking surface, the brake band having a first end connected to the first end of the pivotally mounted member, and having a second end connected to the second end of the pivotally mounted member;

a resilient member forming said connection between one end of said pivotally mounted member and the corresponding end of the brake band;

positioning means communicating with the pivotally mounted member intermediate the first and second ends of said member to position said member so as to cause the brake band to frictionally engage the frictional braking surface to cause a predetermined frictional force to be exerted by said rotatably mounted member which force is communicated as a resistance load to said roller on said exercise device.

4. An apparatus as defined in claim 3, wherein said positioning means comprises a self-correcting servomotor.

5. An apparatus as defined in claim 3, wherein one end of said pivotally mounted member is connected to the corresponding end of said brake band by a spring.

6. An apparatus as defined in claim 5, wherein said positioning means comprises a self-correcting servomotor.

7. An apparatus as defined in claim 3, wherein said positioning means is connected to said pivotally mounted member intermediate said first end of said pivotally mounted member and the pivot point about which said member pivots.

8. An apparatus as defined in claim 7, wherein said pivotally mounted member is pivotally mounted off of the center of said pivotally mounted member, toward said first end of said pivotally mounted member.

9. An apparatus as defined in claim 4, further comprising:

a computer programmed to provide a predetermined sequence of signals to said servomotor in order to simulate predetermined load resistances to said exercise device.

10. An apparatus as defined in claim 6, further comprising:

a computer programmed to provide a predetermined sequence of signals to said servomotor in order to simulate predetermined load resistances to said exercise device.

11. An apparatus as defined in claim 4, wherein said rotatably mounted member is a flywheel.

12. An apparatus as defined in claim 10, wherein said rotatably mounted member is a flywheel.

13. An apparatus, comprising:

an exercise device having a rotating roller; means for mounting a bicycle frame and pedals to the exercise device so that a resistance force applied to the roller is transmitted to the pedals;

a differential band brake communicating with said roller to exert a variable resistance load on said roller, the differential band brake further comprising:

a rotatably mounted member having a friction braking surface;

a pivotally, mounted member having a first and second end, the member being pivotally mounted intermediate the first and second ends;

a brake band adjacent at least a portion of said friction braking surface, the brake band having a first end connected to the first end of the pivotally mounted member, and having a second end connected to the second end of the pivotally mounted member;

a resilient member forming said connection between one end of said pivotally mounted member and the corresponding end of the brake band;

positioning means communicating with the pivotally mounted member intermediate the first and second ends of said member to position said member so as to cause the brake band to frictionally engage the frictional braking surface to cause a predetermined frictional force to be exerted by said rotatably mounted member which force is communicated as a resistance load to said rollers; and means for communicating the variable resistance load to said roller.

14. An apparatus as defined in claim 13, wherein said said pivotally mounted member is pivotally mounted such that the ratio of the distance from the pivot point to the nearest end of said member, to the distance from the pivot point to the most distant end of said member, is between 1.7 and 3.0.

15. An apparatus as defined in claim 14, further comprising a computer programmed to control the frictional force by controlling the position of said positioning means.

* * * * *